US006209598B1

(12) United States Patent
Petrey

(10) Patent No.: US 6,209,598 B1
(45) Date of Patent: Apr. 3, 2001

(54) COVER FOR CONCEALING AN INSIGNIA SIDE OF A SIGN

(76) Inventor: Todd H Petrey, 435 Davis St., Neptune Beach, FL (US) 32266

( * ) Notice: Subject to any disclaimer, the term of this patent is extended or adjusted under 35 U.S.C. 154(b) by 0 days.

(21) Appl. No.: 09/104,897

(22) Filed: Jun. 25, 1998

(51) Int. Cl.[7] ..... B65D 65/02

(52) U.S. Cl. ..... 150/154; 160/368.1; 160/10; 40/612

(58) Field of Search ..... 40/617, 612, 610; 160/368.1, 10; 150/154, 166, 167, 168

(56) References Cited

U.S. PATENT DOCUMENTS

| | | | | |
|---|---|---|---|---|
| 2,279,812 | * | 4/1942 | Bartlett | 150/166 |
| 2,455,237 | * | 11/1948 | Davis | 150/154 |
| 3,276,512 | * | 10/1966 | Gallagher | 150/166 |
| 3,785,451 | | 1/1974 | McCord . | |
| 4,069,853 | | 1/1978 | Surabian . | |
| 4,090,464 | | 5/1978 | Bishopp et al. . | |
| 4,221,085 | | 9/1980 | Conaghan . | |
| 4,674,787 | * | 6/1987 | DeVera | 150/154 |
| 4,793,082 | * | 12/1988 | Petrick et al. | 40/611 X |
| 5,058,299 | * | 10/1991 | Suzuki | 40/611 |
| 5,152,091 | * | 10/1992 | Leach | 40/612 X |
| 5,218,775 | | 6/1993 | Singer . | |
| 5,351,733 | | 10/1994 | Ullman . | |
| 5,460,409 | * | 10/1995 | Conner | 160/368.1 |
| 5,511,655 | | 4/1996 | Porter . | |
| 5,611,501 | * | 3/1997 | Crandley | 150/166 X |
| 5,715,881 | * | 2/1998 | Ruskamp et al. | 150/154 |
| 5,729,926 | * | 3/1998 | Cowgill et al. | 40/610 |
| 5,741,041 | * | 4/1998 | Sullivan | 150/166 X |
| 5,804,275 | * | 9/1998 | Tsunefuji | 428/105 |
| 5,839,237 | * | 11/1998 | Davidson | 150/154 |

* cited by examiner

*Primary Examiner*—Stephen P. Garbe
*Assistant Examiner*—Tri M. Mai
(74) *Attorney, Agent, or Firm*—Mark J. Young

(57) ABSTRACT

The sign covering of the present invention is an all weather covering for concealing the insignia side of a sign, and more particularly a roadway sign. The covering is made of a weather resistant fabric, such as polypropylene, and is light enough for a single person to install. The sign covering does not damage the sign nor is it susceptible to the elements. Typically, straps affixed to a sheet covering the insignia side of the sign hold the cover in place. The straps are tied at the back of the sign using a cord fitted through the eyelets of grommets positioned at the free end of each strap and into the corresponding grommets that are positioned at the opposite edge of the sheet. Once securely attached, the sign cover effectively hides the insignia side of the sign from view.

5 Claims, 3 Drawing Sheets

COVER FOR CONCEALING AN INSIGNIA SIDE OF A SIGN

BACKGROUND

Road signs convey important information to the driving public every day. Road sign insignia can indicate speed limits, exits, services and other messages helpful to drivers. Unfortunately, not all road signs communicate accurate or pertinent information. Events such as road repairs and improvements often render a sign's message irrelevant or invalid due to the construction activity. The construction activity dictates the sign's removal or concealment until the activity is finished.

Road construction crews typically remove road signs during construction projects scheduled to last for a year or more. For construction projects scheduled to last for a few months, road crews typically just cover road signs rather than incur the added expense of removing or changing the inappropriate sign. Unfortunately, a majority of the concealment schemes employed by construction crews are destructive to the sign.

One popular method of covering a traffic sign is to bolt a sheet of plywood to the insignia side of the sign. Bolts disfigure the sign when driven through both the plywood and the sign's sheet metal face. Workers secure the bolt in place with a nut and washer combination on the backside of the sign. Initially, bolted plywood may effectively conceal the sign, but plywood, when exposed to the weather tends to warp and crack. Untreated plywood is also prone to decay and rot. Warped, cracked or rotted plywood may eventually break free of the bolts and detach from the sign. In addition to plywood's vulnerability to weather, it is a considerably dense material requiring several crewmembers to attach the wood to the sign.

Bolting similar sized signs to the insignia side of a traffic sign is another method of concealing a sign. The method entails securing the insignia side of a similar sized sign to the insignia side of the traffic sign so that only the blank sheet metal side of each is showing. This procedure not only injures the traffic sign to be covered up but also leaves a bolt hole through the covering sign. While this procedure may employ the use of a more durable material than wood, the procedure is also twice as destructive and more expensive.

Other less expensive and less permanent measures have been utilized in an attempt to cover up the insignia side of a sign. Plastic or burlap bags can be placed over the signs. To hold the bags in place workers often use an industrial tape such as duct tape. Such measures rarely last as the elements quickly tear away at the plastic or burlap covering. Soon only a partially shrouded sign and duct tape is all that is left of the sign covering after a few weeks.

A sign covering is needed that is both nondestructive and resistant to the elements. The covering should also be lightweight and easily installed. A successful cover must also be relatively inexpensive and simple to use.

SUMMARY OF THE INVENTION

The sign covering of the present invention is an all weather covering for concealing the insignia side of a sign, and more particularly a roadway sign. The covering is made of a weather resistant fabric, such as polypropylene, and is light enough for a single person to install. The sign covering does not damage the sign nor is it susceptible to the elements.

The cover panel is typically rectangular in shape and dimensioned slightly larger than the sign to be covered.

Straps attached to the cover panel are used to attach the cover to the sign's face. The straps are tied at the back of the sign using a cord fitted through the eyelets of grommets positioned at the free end of each strap and into the corresponding grommets that are positioned at the opposite edge of the panel. Once securely attached, the sign cover effectively hides the insignia side of the sign from view.

Hooks, operably affixed to the top edge of the panel, are added to aid in the implementation of the present invention. The hooks grasp the top edge of the road sign allowing the panel to freely hang in place over the insignia side of the sign. Once hung, a single worker can securely attach the panel to the sign.

DETAILED DESCRIPTION

Figure 1:
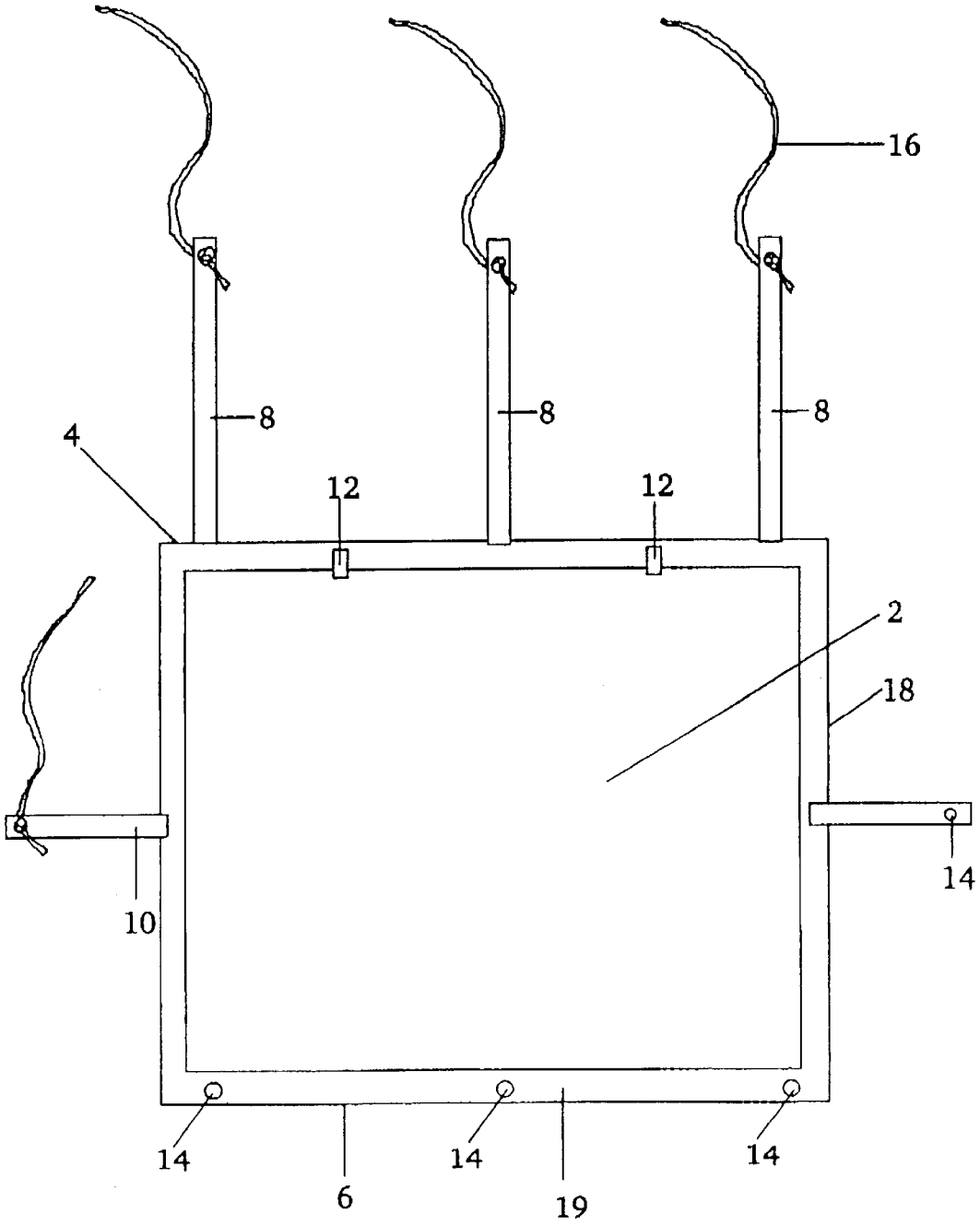
FIG. 1 is a schematic view of a sign cover detailing a strap and cord attachment means, also shown are hook grasping devices and reinforced border and opaque panel.

The sign cover, as shown in FIG. 1, comprises an opaque panel 2 for concealing the insignia side of a road sign, hooks 12 for grasping the top edge of the sign, vertical 8 and horizontal 10 straps, and grommets 14 for connecting the straps to the panel with cords 16 so as to securely fasten the sign cover to the sign.

The panel 2 is constructed from an opaque material capable of concealing the sign when draped over the sign's insignia side. The material should be light and durable, requiring only one worker to deploy the sign cover. The material should not be susceptible to the elements and durable enough for many seasons of use as required by most state material regulations. Preferably, the panel 2 is constructed from a woven polypropylene having a 17 mil thickness and is sized to substantially cover the sign intended to be covered. Additional polypropylene characteristics include a puncture strength of 160 lbs., burst strength of 535 lbs/in$^2$, and a weight of 5.9 oz/yd$^2$. However, any lightweight durable material would suffice, such as vinyl or woven natural fibers treated to resist weathering.

The panel 2 is preferably constructed from a woven fabric having an air flow rate of 50 cfm as determined by ASTM D737, but other rates are acceptable so long as the fabric remains opaque. A certain amount of airflow through the sheet (i.e., porosity) is desired, thus a woven fabric is preferred over a solid polypropylene sheet. A solid sheet resists wind to a greater degree and has an increased propensity to tear over a woven fabric. A woven panel is also stronger than a solid sheet, and the weave of the woven fabric enables a certain percentage of air to flow through the panel 2. In addition, air flow aids evaporation and the woven fabric would be less likely to suffer from water damage.

The borders 19 of the panel 2 are reinforced with polypropylene tape to prevent fraying and to provide a reinforced backing. The polypropylene tape is stitched to the panel 2 using nylon thread. Other synthetic materials may also be used to reinforce the borders 19 of the panel 2. Typically, materials made from untreated natural fibers are avoided since such materials are susceptible to decay when exposed to the elements.

Affixed to the top edge 4 of the panel 2 is a grasping device. Preferably the grasping device is a hook 12 as illustrated in FIG. 1. Only one hook is needed, but two operably spaced hooks 12 affixed to the top edge border 19 are preferred. The hooks 12 are spaced to grasp the top edge of the sign and to hold the panel 2 in place over the insignia side of the sign while the panel is being securely attached to the sign. The hooks 12 provide an individual worker with the ability to deploy the sign cover unaided. Typically, the hooks 12 are hanger clips made of a synthetic material that is weather resistant and relatively strong. Other grasping means may also be used such as magnets, clipping devices and pinching devices.

In an alternative embodiment the grasping means may also be an envelope formed by the panel 2 and a second opposed panel. The opposed second panel is attached at the top edge 4 and the lateral edges 18 of the panel 2, the space formed between the panels defining a pocket. The pocket fits over the top edge of the sign to hold the sign cover in place while the cover is attached to the sign. The second opposed panel can be of varying lengths including the same length as first opposed panel, but a length of 1" to 10" is preferred.

The sign cover of the present invention is attached to the sign using various attachment mechanisms. As illustrated in FIG. 1, the panel 2 has attached both vertical 8 and horizontal 10 straps. The vertical straps 8 are affixed to the top edge 4 of the panel 2 by sewing the straps in place with nylon thread. Typically, three straps are affixed to the top edge 4, but the number is not critical so long as the panel 2 substantially covers the sign and is securely attached. The horizontal strap 10 is affixed to the lateral edge 18 by they same means as the vertical straps 8. Preferably, only one horizontal strap 10 is needed. The straps are preferably formed from polypropylene tape and are functionally sized.

A grommet 14 is affixed at the free end of each strap and a grommet 14 is affixed in the border 19 directly opposite each strap. Typically, the grommets 14 are made of a weather resistant material such as brass and are ½" in diameter. The eyelet formed by each grommet 14 receives an end of a nylon rope or cord 16. Preferably, grommets 14 are positioned within the free end of each strap. The grommets 14, positioned within the fee end of each strap are threaded with one end of the nylon rope. Once threaded, a knot is tied near the end of the rope, preventing the rope from being pulled through the eyelet of the grommet 14. The second end of the rope 16 is threaded through an eyelet of a grommet 14 positioned at the opposing edge. Once threaded, the second end of the rope is pulled tight and a knot is made at the end. With the rope 16 threaded and knotted, the free end of the strap then becomes removably connected to the opposing edge of the panel 2. The vertical straps 8 can form a variety of patters when connected, such as crisscross or parallel patterns.

In an alternative embodiment, the straps are removably connected to their respective opposing edges by a bungee cord having hooks at both ends. The bungee cord can be of any derivation of flexible cord. One hooked end of the bungee cord is hooked through the eyelet of the grommet affixed at the free end of a strap and the second hooked end is hooked through the eyelet of the grommet affixed in the opposing edge. Once connected, the bungee cord urges the opposing sides together. The bungee cord should be taught when in place so as to urge the opposing edges together.

Figure 2:
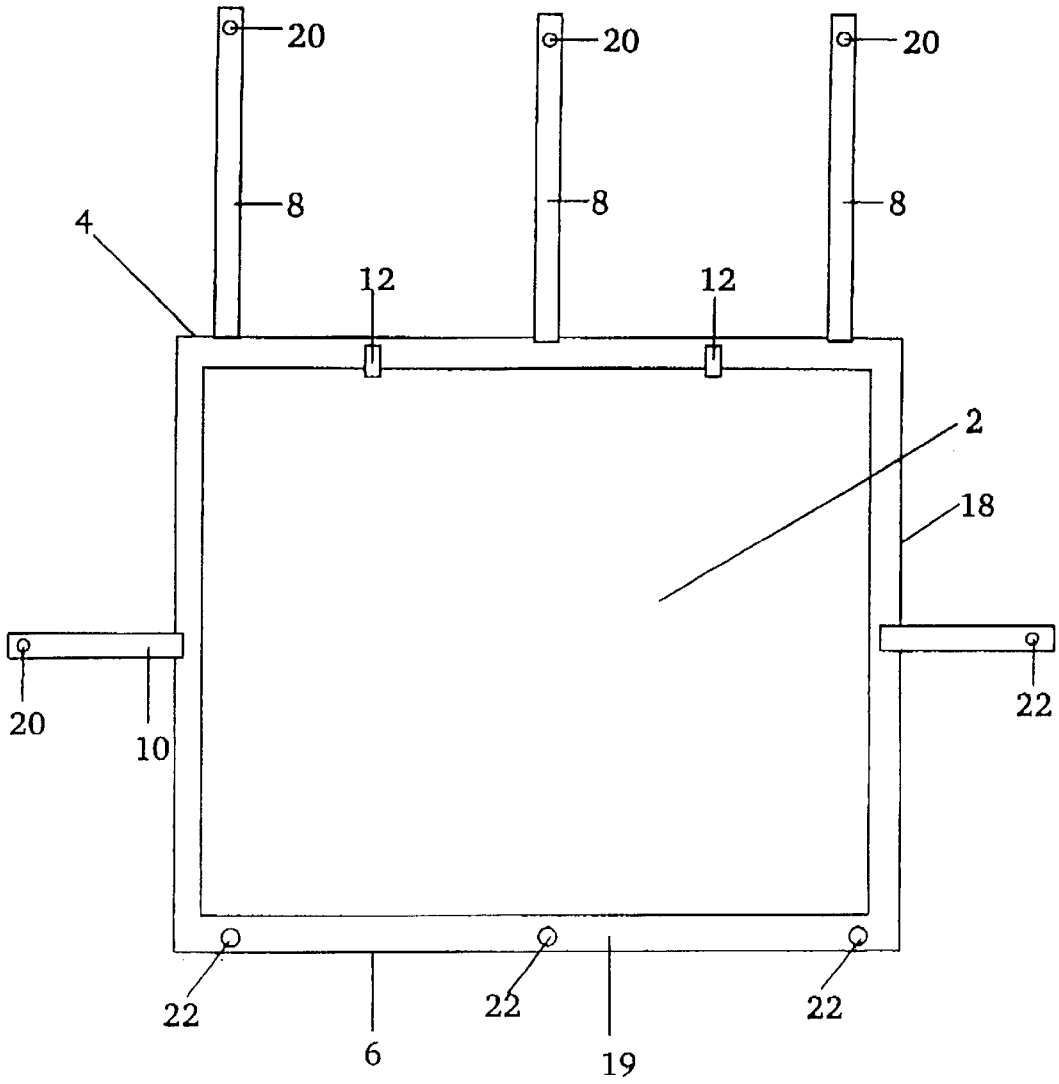
FIG. 2 is a schematic view of a sign cover detailing a snap attachment means plus a grasping means as a hook and an opaque panel.

In the embodiment of FIG. 2, the opposing edges are brought together by a row of snaps. Each snap has a clasp member 22 and an insert member 20. The clasp members 22 are attached to the face of the panel 2 near the edge portions and are aligned to grasp a corresponding insert member 20. The insert members 20 are attached to the underside of each strap. The sign cover is securely attached to the sign once the insert members 20 and their respective clasp members 22 are engaged.

Figure 3:
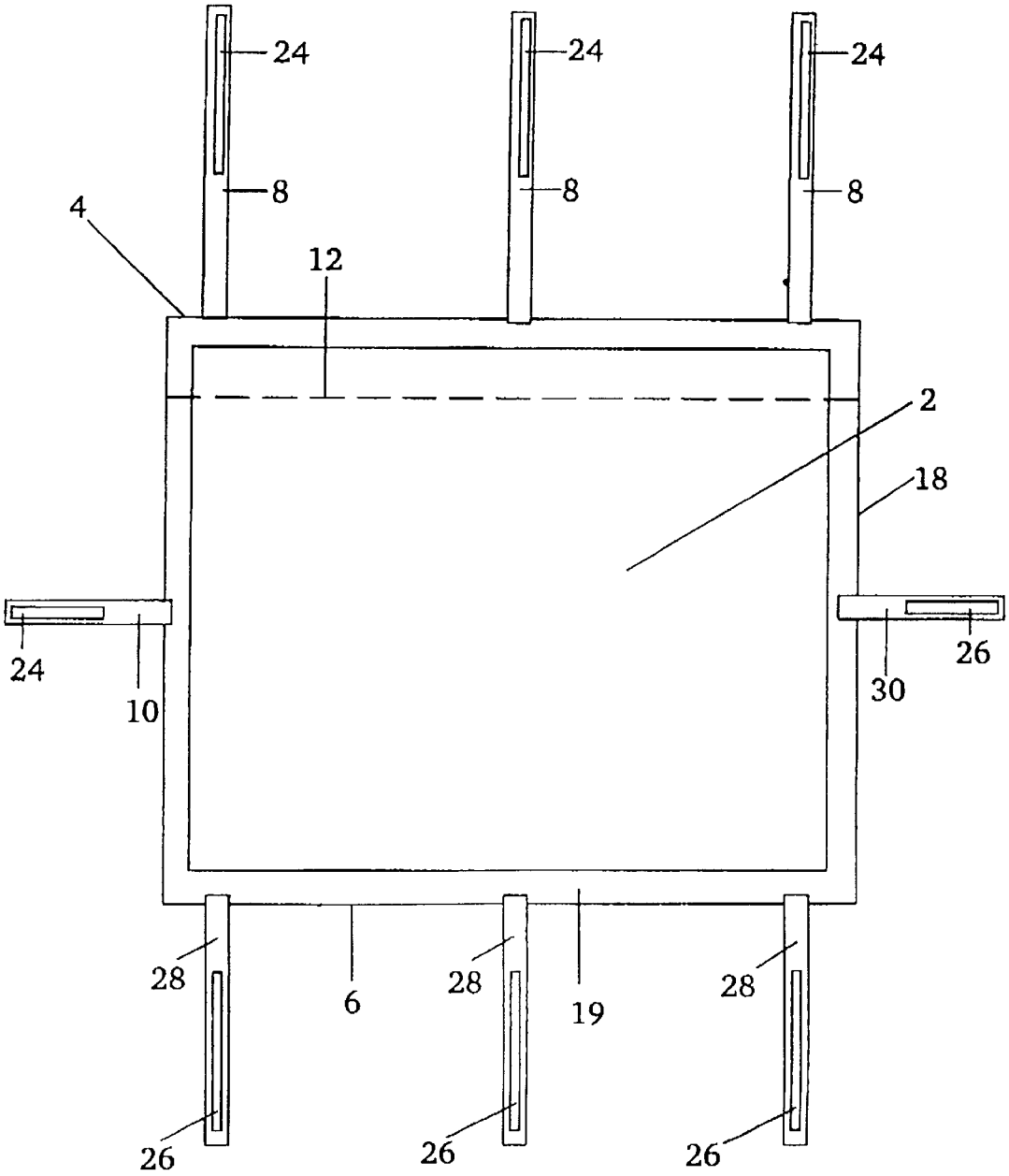
FIG. 3 is a schematic view of the sign cover detailing a hook and loop attachment means along with a grasping means as a hook and a opaque panel.

In the embodiment of FIG. 3, a hook and loop fastening system is used to attach the sign cover to the sign. A first fastening strip 24 is affixed to the underside of each first vertical strap 8 and each first horizontal strap 10, while the second fastening strip 26 is affixed to each second vertical strap 28 and each second horizontal strap 30. The fastening strips are aligned to make frictional contact when the straps of the opposing edges are brought together. The first fastening strip 24 is a hook fastening strip and the second strip 26 is a loop fastening strip. When forced together, a plurality of hooks on the first strip 24 attach to loops on the second strip 26 to secure the sign cover to the sign.

Other attachment means exist for securing the panel 2 to the insignia side of a road sign but have not been illustrated. Such attachment means include, but not limited to, buckles, zippers, elastic, friction fit loops, and draw strings. The above are examples of possible attachment means, but in no way should be read to be an exclusive or exhaustive list of possible attachment means.

While this invention is susceptible of embodiment in many different forms, there is shown in the drawings and has been described in detail having several specific embodiments, with the understanding that the present disclosure is to be considered as an exemplification of the principles of the invention and is not intended to limit the invention to the embodiments illustrated.

What is claimed is:

1. A cover for concealing an insignia side of a sign, comprising:

an opaque sheet having a top edge, a bottom edge and opposed first and second lateral edges, the sheet comprising a porous material;

a grasping means for grasping the sign, the grasping means being affixed to the top edge of the sheet; and attachment means for attaching the opaque sheet to the sign, wherein the attachment means includes:

one or more vertical straps having an attached end and a free end, the attached end being affixed to the top edge of the sheet, and the free end of each vertical strap having a grommet positioned within;

one or more grommets attached to the bottom edge of the sheet, each grommet attached to the bottom edge of the sheet being operably aligned with one of said one or more vertical straps and removably connected to the grommet positioned within the free end of thc vertical strap;

one or more horizontal soaps having an attached end and a free end, the attached end being affixed to the first lateral edge of the sheet, and the free end having grommets positioned within; and one or more grommets attached to the second lateral edge of the sheet, each grommet attached to the second lateral edge of the sheet being operably aligned with one of said one or more horizontal straps and removably connected to the grommet positioned within the free end of the horizontal strap.

2. A cover for concealing an insignia side of a sign according to claim 1, wherein the grasping means includes one or more hooks operably affixed to the top edge of the sheet.

3. A method for concealing an insignia side of a sign using the cover according to claim 1, comprising the steps of:

grasping the top of the sign with the grasping means;

draping the opaque sheet ever the insignia side of the sign; and attaching the opaque sheet to the sign using the attachment means.

4. A cover for concealing al insignia side of a sign, comprising:

an opaque sheet having top edge, a bottom edge and opposed first and second lateral edges, said sheet being comprised of woven polypropylene fabric;

a grasping means for grasping the sign, the grasping means being affixed to the top edge of the sheet, said grasping means being comprised of one or more hooks operably affixed to the top edge of the sheet; and attachment means for attaching the opaque sheet to the sign, said attachment means being comprised of:

one or more vertical straps having an attached end and a free end, the attached end being affixed to the top edge of the sheet, and the free end of each vertical strap having a grommet positioned within;

one or more grommets attached to the bottom edge of the sheet, each grommet attached to the bottom edge of the sheet being operably aligned with one of said one or more vertical straps and removably connected to the grommet positioned within the free end of the vertical strap;

one or more horizontal straps having an attached end and a free end, the attached end being affixed to the first lateral edge of the sheet, and the free end having grommets positioned within; and one or more grommets attached to the second lateral edge of the sheet, each grommet attached to the second lateral edge of the sheet being operably aligned with one of said one or more horizontal straps and removably connected to the grommet positioned within the free end of the horizontal strap.

5. A method for concealing an insignia side of a sign using the cover according to claim 4, comprising the steps of:

grasping the top of the sign with one or more hooks operably affixed to the top edge of the opaque sheet;

draping the opaque sheet over the insignia side of the sign;

connecting the grommet positioned within the free end of each vertical strap to the grommet attached to the bottom edge of the sheet and operably aligned with said vertical strap; and connecting the grommet positioned within the free end of each horizontal strap to the grommet attached to the second lateral edge of the sheet and operably aligned with said horizontal strap.

* * * * *